United States Patent [19]

Petrovich

[11] 4,225,428

[45] Sep. 30, 1980

[54] FROTH FLOTATION METHOD FOR RECOVERING METAL VALUES

[76] Inventor: Vojislav Petrovich, 1935 W. Schiller St., Chicago, Ill. 60622

[21] Appl. No.: 5,099

[22] Filed: Jan. 22, 1979

[51] Int. Cl.[3] ..... B03D 1/02

[52] U.S. Cl. ..... 209/166

[58] Field of Search ..... 209/166, 107

[56] References Cited

U.S. PATENT DOCUMENTS

| | | | |
|---|---|---|---|
| 3,845,862 | 11/1974 | McGuire | 209/166 |
| 3,909,399 | 9/1975 | Petrovich | 209/166 |
| 3,923,647 | 12/1975 | Petrovich | 209/166 |
| 4,006,014 | 2/1977 | Gannon | 209/166 X |
| 4,098,686 | 7/1978 | Petrovich | 209/166 |

*Primary Examiner*—Robert Halper

[57] ABSTRACT

A froth flotation method for recovering native silver and copper, and metallic ores selected from the group of silver, copper, nickel, cobalt, and chromium, by applying commercial quaternary bases or their salts in conjunction with perchloric acid to obtain pure concentrates of said metal values, which comprises; adding to a water suspension of finely divided ore of quaternary ammonium type collectors of commercial origin, and an adequate amount of perchloric acid, which acting in conjunction activate and levitate in the froth by usual froth flotation process the metal values of silver, copper, nickel, cobalt, and chromium.

1 Claim, No Drawings

FROTH FLOTATION METHOD FOR RECOVERING METAL VALUES

This invention relates to the beneficiation of native silver, and copper, and the metal values of silver, copper, nickel, cobalt, and chromium minerals.

Accordingly, this invention has as a prime object to provide a practical and economical process for the beneficiation of native silver and copper, and the beneficiation of silver, copper, nickel, cobalt, and chromium ores. The application, in said beneficiation method, of commercial quaternary bases or their salts in conjunction with perchloric acid the most gangue minerals are unaffected, such as silica and the silicates, especially ferromagnesian silicates, all iron minerals, as well as the usual gangue minerals. Thus chromite from the black sands and the beach sands, which are a mixture of magnetite, ilmenite, rutile, monazite, and the like minerals may be recovered as pure sand concentrates. The present invention points to a cheap technically accessible and reliable method for concentration of above said metal values from their ores to marketable products.

Accordingly, the invention has as an object the provision of a simple, expedient, and inexpensive method, i.e., practical and economical process for the beneficiation of silver, copper, nickel, cobalt, and chromium ores. Another object of this invention is to provide a mineral concentrating treatment for the beneficiation of said ores involving selective activation of the desired mineral and the production of a high-grade concentrate with maximum recovering of desired metal values of the above enumerated metals, with a very low consumption of reagents.

The present invention points to a variety of feasibility in recovering metal values. Thus, the feasibility of furnishing pure nickel, cobalt, and chromium concentrates to metallurgy is a big advantage in application of this invention. Not a less significant value of this invention is the feasibility of concentrating disseminated native silver and native copper. Furthermore, the videly distributed mafic and serpentinized mafic rocks have scatered nickel silicate minerals, which are present in said rocks rarely more than two percent. The concentration of such nickel minerals are out of sight until now and this invention. The dressing of such rocks, the preparation of nickel concentrates for metallurgical use is very diverse, complex, and complicated operations, and always expensive. The present invention is a breakthrough in beneficiation of nickel silicate minerals, as well as lateritic nickel ores. Moreover, the black sands and the beach sands with a certain percentage of chromite mineral are highly amenable to the flotation procedure of this invention. Besides being predominantly composed of magnetite, the black sands contain ilmenite, rutile, sphene, zircon, monazite, garnet, corundum, kyanite and the related minerals, and often chromite. If chromite mineral is present in a substantial percentage, such black sands merit to be concentrated for the recovery of chromite. All minerals mentioned as ingredients of a black sand deposit are unaffected by said combination of reagents. Many of said accessory minerals may be recovered by means of other froth flotation procedures and collectors. The unsolved problem of beneficiation of black sands was the chromite, which does not posses magnetic properties, nor may be recovered electrostatically. The present invention has solved this problem.

Frequently copper ore deposits contain zinc minerals such as sulfide, sulfate, carbonate, and silicate of zinc. Furthermore, copper ores may contain iron minerals, such as sulfide, oxide, carbonate, or silicate minerals of iron, lead minerals, such as sulfide, sulfate, or carbonate of lead; moreover, calcite, ankerite, barytes, rhodonite, rhodochrosite and the like minerals. No one of said minerals respond to the collectors of this invention, thus a high-grade copper concentrate may be obtained.

Silver minerals, native silver scattered in certain deposits of barren rocks, or scattered in barytes, or ankerite-calcite deposits may be successfully recovered if the amount of ounces warrant a profitable work.

Moreover, as will be seen from what follows, the time of flotation required is comparatively short as compared to conventional flotation circuits. This not only means an appreciable saving in capital cost but also is an important reduction in operating costs, because the flowsheets with reagents of this invention are shorter and more direct, which is a big technical advantage. The said quaternary ammonium bases or their salts, as well as the perchloric acid are very soluble, the perchloric acid as the strongest acid replaces chlorine ion of quaternary ammonium chloride in the pulp of mineral slurry, forming perchlorates, which as such are complexing agents at the mineral surface. Thus, the perchlorates of quaternary ammonium bases are particularly adapted for the use in highly selective froth flotation process for recovering of silver, copper, nickel, cobalt, and chromium metal values, for, the most gangue minerals are unaffected as well as the minerals of heavy metals such as those of zinc and lead.

The object of this invention is to provide an improved froth flotation procedure in which, through the application of commercial quaternary ammonium chlorides in conjunction with perchloric acid wanted minerals selected from the group of silver, copper, nickel, cobalt, and chromium minerals in respective ores are activated and floated in the froth formed by agitating and aerating the pulp of mineral slurry.

The commercial quaternary ammonium chlorides used in this invention having commercial names such as:

- ALIQUAT 336, which is: Tricaprylylmethyl ammonium chloride, a product of GENERAL MILLS Chemical Inc.
- ARGUAD 10, which is: Didecyldimethyl ammonium chloride, a product of ARMAK Chemical Company
- ADOGEN 464, which is: Methyltridecyl ammonium chloride, a product of ASHLAND CHEMICALS Company ALIQUAT 336 is used as ion exchange reagent in the extraction concentration of anions from aqueous acidic and alkaline solution of metals.

ARGUAD 10, is generally slime, clay, silica and silicate slimes and colloidal particles flocculant.

ADOGEN 464, is used as solvent extraction reagents for vanadium, tungsten, and uranium from neutral or alkaline solution.

Such a versatile application and not as direct froth flotation reagents, said quaternary ammonium bases and chlorides when used in conjunction with perchloric acid, acting complexing, become metallic mineral collectors, which is the essence of this invention and a real improvement in froth flotation art.

The special feature of this invention is that cationic reagents of quaternary ammonium type which are flocculants for general slimes, extractants for in acid or alkalies disolved metals, providing in this way different processes than is the froth flotation process, extracting process being more expensive in operating costs as well as in investment costs, cannot compete with froth flotation process in which great economy in reagent costs may be achieved. By applying the present invention it is feasible to obtain an increased recovery of enumerated metal values in respective froth concentrates, with a reduction in reagent requirements and costs, thus, a substantial advancement is feasible in the field of recovering of silver, copper, nickel, cobalt, and chromium values.

An object of the present invention is to accomplish the above results. A further object is to provide a process requiring only one operation, i.e., froth flotation operation to produce a finished concentrate for the metallurgy with a reduction in reagent requirement and costs, and an increase in mineral recovery. A further object is to provide a process which tolerates relatively large amounts of −150 mesh slimes without seriously affecting reagent consumption or metallurgical results so that the desliming and sizing of the feed is less critical. A further object is to provide a process permitting the plant to operate efficiency at lower conditioning time and lower percent of solids levels. Yet another object is to provide a process which greatly extends the pH range in which good conditioning and flotation are possible. Other specific object and advantages will appear as the specification proceeds.

Although the exact mechanism by which the quaternary ammonium bases or their salts such as ALIQUAT 336, ARGUAD 10, and ADOGEN 464 perform their useful function in conjunction with perchloric acid in processes of this invention is not fully understood, which until now is neither observed nor explained; the commercial quaternary ammonium bases being used mostly as extractants of dissolved metallic salts in the process of extractive metallurgy, or as flocculants in slime treatments and slime check in froth flotation do not through much light in the process of froth flotation. Therefore, the addition of perchloric acid is indispensable. The perchloric acid appears to be co-promoter, and complexing agent to the action of commercial quaternary ammonium bases and their salts such as chlorides.

The foregoing process greatly improves the selectivity in the froth flotation separation of silver, copper, nickel, cobalt, and chromium minerals from most gangue minerals as well as from heavy metal minerals, in which strongly cationic-type collectors such as commercial quaternary chlorides in conjunction with perchloric acid perform excellent results in concentrating above said metal values. The process further reduces the need for close plant control in critical areas such as desliming, sizing, conditioning, and reagent rates, reducing flotation reagent requirements and processing costs.

Highly efficient results and considerable reagent economy have been effected in the practicing of this invention when the commercial quaternary chlorides were employed in conjunction with perchloric acid with the ore slurry pulp, and to this end it is preferred to employ said quaternary ammonium chlorides only in small or very small amounts, because said commercial quaternary chlorides are very soluble and dissociated, because of which the last molecule of them will be utilized for complexing perchloric acid at the mineral surface. Because the perchloric acid is also totally dissociated, the both reagents will be entirely exhausted from the pulp of mineral slurry in performing their froth flotation duty, being thus very effective collectors. But being poor frothers a litle frother must be added for a full success.

In carrying out of this invention in accordance with the foregoing principles, the selected one is ground, sized, and then preferably although not necessarily deslimed by washing to remove colloidally dispersed material, and thereafter the sands are diluted to a pulp consistency of generally about 25 percent solids. Thereafter, the pulp is conditioned for several minutes by agitating with an amount of the order 0.01 to 0.1 kg per ton of ore treated of a quaternary ammonium chloride and perchloric acid in an amount of the order 0.01 to 0.1 kg per ton of ore treated as co-promoter. Thus, the pulp of mineral slurry is conditioned for a suitable lenght of time of about 5 minutes, followed by aeration, and than the flotation is initiated. The usual rougher and cleaner procedure are employed and the procedure of this invention can well be utilized in a cyclic process wherein the spent water of tailing and concentrate, as well as the middling ore fraction are returned to the process or reground if coarse.

Summing up, the present invention comprises a method for the beneficiation of silver, copper, nickel, cobalt, and chromium metal values which comprises; comminuting the ore to liberate substantially all the metal value from gangue, and adding to the pulp of mineral slurry one of the said commercial quaternary chlorides, and an adequate amount of perchloric acid. Thus, in accordance with the invention the minerals of said metal values are rendered responsive to levitation from silicious gangue and oxide or sulfide accessory mineral of the treated mineral slurry. The said metal vaues are collected as froth concentrates.

The following Examples will facilitate a more complete understanding of the present invention, but they are not meant to limit the scope of the invention to the specific embodiments incorporated therein, i.e., to the three commercial quaternary ammonium chlorides, obtained from GENERAL MILLS, ARMAK, and ASHLAND CHEMICALS with which this invention was experimented and proved. The similar commercial quaternary salts products of other Chemical Companies are also applicable to perform this invention. The above discussion as well as the disclosure illustrates my invention in a broad and general way, for a detailed description thereof the Examples of preferred embodiments are set forth below.

TABLE I

| Example ore treated | Promoter kg/t | Collector kg/t | Feed % | Recovery % conc. | tailing |
|---|---|---|---|---|---|
| 1. native silver Callico ore | Perchloric acid 0.01 | ALIQUAT 336 0.01 | 8.3 ounces | estimated by microscopic count 90.0 | 10.0 |
| 2. Michigan native copper | 0.02 | ALIQUAT 336 0.02 | 2.1 | 80.0 | 20.0 coarse |

TABLE I-continued

| Example ore treated | Promoter kg/t | Collector kg/t | Feed % | Recovery % conc. | tailing |
|---|---|---|---|---|---|
| 3. Arizona copper ore | 0.05 | ARGUAD 10 0.05 | 1.8 | 94.0 | 6.0 |
| 4. New Caledonia nickel silicate ore | 0.03 | ARGUAD 10 0.03 | 2.4 | 91.0 | 9.0 |
| 5. Morocco cobalt ore | 0.05 | ADOGEN 464 0.05 | 2.1 | 88.0 | 12.0 |
| 6. Cyprus chromite table slime | 0.1 | ADOGEN 464 0.1 | 26.0 | 96.0 | 4.0 |
| 7. Oregon chromite sand | 0.07 | ALIQUAT 336 0.07 | 12.0 | 92.0 | 8.0 |

It is to be understood that the use of various amount of depressants, dispersants, frothers etc. in different stages may be used to the advantage to obtain the highest yield and best separation.

The Table 1 shows that commercial quaternary ammonium chlorides as well as the bases are excellent collectors for metallic minerals of silver, copper, nickel, cobalt, and chromium, as well as for disseminated native metals such as silver and copper, when used in conjunction with perchloric acid. Thus, the commercial quaternary ammonium chlorides such as ALIQUAT 336, ARGUAD 10, and ADOGEN 464, products of various Chemical Companies above mentioned, which when independently used and alone are flocculant for clayly, colloidal and slimy material, as well as extractants of metal values from their water solutions, which also function as ion exchange vehicles as ingredients in ion exchange resins and the like materials, but in conjunction with perchloric acid said quaternary ammonium chlorides act as collectors for native silver and native copper, silver, copper, nickel, cobalt, and chromium minerals.

Considering the results, the conclusion is: that not only the ration of concentration of valuable minerals is considerably raised, but also is highly performed with reagents which normally are not metallic mineral collectors. A feasible froth flotation process is modified by which the ratio of depressed gangue is considerably lowered by conditioning the pulp of mineral slurry with said commercial quaternary ammonium chlorides, or bases derived from them, in conjunction with perchloric acid. Therefore, the use, according to the present invention of commercial quaternary chlorides in conjunction with perchloric acid for accomplishing the purpose of collecting minerals of silver, copper, nickel, cobalt, and chromium in a process of unaffected gangue minerals constitutes a marked advance in the art of froth flotation, and is highly advantageous in improving the selectivity of the used collectors, thus improving the grade of concentrates.

What is claimed is:

1. In concentrating by froth flotation of native silver and native copper, silver, copper, nickel, cobalt, and chromium ores, which includes subjecting a finely ground aqueous dispersion of said ores to froth flotation process in the presence of commercial quaternary ammonium chlorides or bases derived from them, selected from the group consisting of tricaprylylmethyl ammonium chloride, or didecyldimethyl ammonium chloride, or methyltridecyl ammonium chloride and in the presence of perchloric acid, which acting in conjunction therewith form complexes at the surfaces of said mineral ores; the step of adding to said dispersion an amount of the order from 0.01 to 0.1 kg per ton of ore treated with said quaternary ammonium chlorides, and an amount of the order from 0.01 to 0.1 kg per ton of ore treated with perchloric acid, said aqueous dispersion of ore produces a float product of mineral values by continuing agitation and aeration of the aqueous dispersion, and separating and recovering the mineral values as float concentrate products.

* * * * *